US009518765B2

(12) United States Patent
Laughman et al.

(10) Patent No.: US 9,518,765 B2
(45) Date of Patent: Dec. 13, 2016

(54) SYSTEM AND METHOD FOR CONTROLLING TEMPERATURE AND HUMIDITY IN MULTIPLE SPACES USING LIQUID DESICCANT

(71) Applicant: Mitsubishi Electric Research Laboratories, Inc., Cambridge, MA (US)

(72) Inventors: Christopher Laughman, Waltham, MA (US); Daniel J Burns, Wakefield, MA (US); Scott A. Bortoff, Brookline, MA (US); Richard C. Waters, Concord, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 288 days.

(21) Appl. No.: 14/022,381

(22) Filed: Sep. 10, 2013

(65) Prior Publication Data

US 2015/0068225 A1 Mar. 12, 2015

(51) Int. Cl.

| | |
|---|---|
| ***F25B 45/00*** | (2006.01) |
| ***F25D 17/06*** | (2006.01) |
| ***F25B 43/00*** | (2006.01) |
| ***F25B 15/00*** | (2006.01) |
| ***F24F 3/06*** | (2006.01) |
| ***F24F 3/14*** | (2006.01) |

(52) U.S. Cl.

CPC ..... *F25B 15/00* (2013.01); *F24F 3/065* (2013.01); *F24F 3/1417* (2013.01)

(58) Field of Classification Search

CPC ..... F25B 15/00

USPC ..... 62/77, 190, 474

See application file for complete search history.

(56) References Cited

U.S. PATENT DOCUMENTS 2,798,570 A * 7/1957 Kelley ..... F24F 3/1417 159/4.1
4,373,347 A * 2/1983 Howell ..... B01D 53/263 62/112
4,549,604 A * 10/1985 Brown, II ..... F01K 5/00 165/110

(Continued)

FOREIGN PATENT DOCUMENTS

| | | |
|---|---|---|
| EP | 1091178 A2 | 4/2001 |
| EP | 1887288 A1 | 2/2008 |
| JP | H08189690 A | 7/1996 |

*Primary Examiner* — Henry Crenshaw

(74) *Attorney, Agent, or Firm* — Gene Vinokur; James McAleenan; Hironori Tsukamoto

(57) ABSTRACT

A branch controller operates with a system for temperature and humidity control. The branch controller includes a fluid control system for controlling a flow of the liquid desiccant in an arrangement of channels forming a first path for exchanging the liquid desiccant between a liquid desiccant conditioning unit and at least a first space conditioning unit and a second path for directing the liquid desiccant received from the first space conditioning unit to a second space conditioning unit. The branch controller includes a processor for comparing operational conditions of the first space conditioning unit and the second space conditioning unit. The processor selects between the first path and the second path based on the comparison and commands the fluid control system to control the flow of the liquid desiccant according to the selected path.

19 Claims, 11 Drawing Sheets

(56) References Cited

U.S. PATENT DOCUMENTS 4,635,446 A * 1/1987 Meckler ..... B01D 53/263 62/235.1
4,691,530 A * 9/1987 Meckler ..... F24F 3/1417 62/238.1
4,723,417 A * 2/1988 Meckler ..... B01D 53/263 62/271
4,984,434 A 1/1991 Peterson
5,070,703 A * 12/1991 Wilkinson ..... B01D 53/263 62/101
6,018,954 A * 2/2000 Assaf ..... F24F 3/1411 62/271
6,546,746 B2 4/2003 Forkosh
6,684,649 B1 * 2/2004 Thompson ..... B01D 53/263 62/272
7,430,878 B2 * 10/2008 Assaf ..... F24F 3/1417 261/112.2
7,966,841 B2 6/2011 Lowenstein
8,268,060 B2 * 9/2012 Hargis ..... B01D 53/263 95/159
9,109,808 B2 * 8/2015 Gerber ..... F24F 3/1417
2010/0050666 A1 * 3/2010 Meyer ..... B01D 53/261 62/94
2010/0192622 A1 * 8/2010 Oh ..... F25D 11/022 62/498
2011/0155593 A1 * 6/2011 Zhang ..... B65D 81/268 206/223
2011/0214600 A1 * 9/2011 Hurme ..... B65D 79/02 116/201
2012/0000227 A1 * 1/2012 Matsuura ..... F24F 1/26 62/175
2012/0023980 A1 * 2/2012 Lee ..... F25B 1/10 62/115
2012/0085112 A1 * 4/2012 Wintemute ..... F24F 3/147 62/150
2012/0204588 A1 * 8/2012 Takenaka ..... F25B 29/003 62/238.7
2012/0221198 A1 * 8/2012 Kohavi ..... B60H 1/00414 701/36
2014/0012551 A1 * 1/2014 Laughman ..... G06F 19/704 703/2

* cited by examiner

SYSTEM AND METHOD FOR CONTROLLING TEMPERATURE AND HUMIDITY IN MULTIPLE SPACES USING LIQUID DESICCANT

FIELD OF THE INVENTION

This invention relates generally to temperature and humidity control, and more particularly, to controlling temperature and humidity in multiple spaces using liquid desiccants.

BACKGROUND OF THE INVENTION

The comfort of the occupants in buildings depends on the temperature and the humidity of occupied spaces. The temperature in the occupied space can be affected by factors such as the outdoor air conditions, a change in the number of occupants in the space, or devices in the space that are either producing or removing heat. Similarly, the humidity in the occupied space can be affected by outdoor air conditions, the accumulation of water vapor in the space, or processes that deplete water from the air or exhaust water vapor into the air. In the field of air-conditioning, heat sources that cause the temperature to change are typically called sensible loads, while the sources and sinks of water vapor that cause the humidity to change are called latent loads.

Modern air-conditioning systems are designed to compensate for variations in the temperature and the humidity of the occupied space. When conditions arise in which the temperature and/or humidity are higher than desired for comfort, heat pumps operating in cooling mode can provide both cooling and dehumidification. When conditions arise in which the temperature and/or humidity are lower than desired for comfort, heat pumps operating in heating mode can provide heating. Additional humidification can be accomplished by a humidifier.

The two modes in which the heat pump operates, i.e., heating and cooling modes, are similar. The main difference is that the direction in which the refrigerant flows in the cooling mode is opposite to the direction in which the refrigerant circulates in the heating mode. Because of the similarities between the modes, many of the results that apply to one mode also apply to the other mode. This description focuses on the operation of a system providing a net cooling effect. However, it should be understood that analogous results can also be applied to a system providing a net heating effect.

Conventional vapor-compression air-conditioning systems are usually designed to control the temperature in an occupied space, rather than the humidity. When the temperature is low and the humidity is high, such air-conditioning systems do not operate because the temperature is within an acceptable range. While high humidities often accompany high temperatures, this is not always the case. In some climates, summer air temperatures may not be especially high, but people may still feel uncomfortable because of the high humidity. For example, a rainy summer night with temperatures in the range of 20° C. to 22° C. can have a humidity ratio above 6.8 g water/g dry air (dewpoint above 20° C.). Because the sun has set and the air temperature is moderate, the sensible cooling load on a house can be almost zero. If a conventional vapor-compression-based air-conditioner for the house does not operate, the absolute indoor humidity will be equal to or exceed that of outdoors. For a 24° C. indoor temperature, the relative humidity is at least 80%, which is a level that is uncomfortable, and exceeds the 70% threshold at which mold and mildew proliferate.

Thermal comfort can be improved by regulating the humidity in a space. Industrial and commercial processes, e.g., baking or semiconductor fabrication, also often require precise control of room air humidity to reliably produce high-quality products. Building maintenance concerns also justify humidity control, as building structures that are subject to high humidity conditions are prone to damage by mildew and mold.

Systems incorporating vapor-compression air-conditioning equipment can be used to dehumidify spaces, but these systems are inherently quite inefficient in their use of energy. Such systems generally have to cool the air down below the dewpoint in order to achieve the desired absolute humidity of the process air, and then heaters must be used to reheat the overcooled air to achieve the desired temperature of the process air. This process of first dehumidifying and then reheating the process air consumes a great deal of energy.

Some air-conditioning systems control space humidity using desiccants. Desiccants are materials that can remove water vapor from air by the process of either absorption or adsorption. Frequently used desiccants include silica gel packets commonly found in packing materials. Desiccants can be in liquid or solid: solid desiccants embed the desiccant in a matrix or on a substrate over which humid air flows, while liquid desiccants often includes aqueous solutions of hygroscopic salts, such as lithium chloride (LiCl) or lithium bromide (LiBr), of varying concentration. Systems that exchange water vapor from the air with the desiccant substrate typically include a dehumidifier and the regenerator components.

As the desiccant in a dehumidifier accumulates water, the ability of the desiccant to continue removing water from the air decreases, rendering the desiccant less effective. The effectiveness of the desiccant can be renewed by moving the desiccant to a component located in a separate air stream, i.e., the regenerator, that evaporates the water of the desiccant via the application of heat, and vents the water vapor to the outside environment.

A fundamental problem of systems using solid desiccant is that the dried air exiting the dehumidification component is warmer than the input moist air. This additional heat must also be removed from the air stream by the air-conditioning system, reducing the energy efficiency of the overall air-conditioning process. In contrast, a system with liquid desiccant does not generally exhibit this pronounced behavior, and can be used to simultaneously cool and dehumidify the air. Systems using liquid desiccants rely on the physical process of absorption. The heat and mass exchangers effecting the process of dehumidification are called absorbers.

For example, U.S. Pat. Nos. 6,546,746, 4,984,434, 6,684,649, 8,047,511, and 8,268,060 describe examples of liquid desiccant-based air conditioning systems with a few variations, such as the means of regeneration or the types of materials used in some of the components. U.S. Pat. No. 7,966,841 describes an example a particular kind of absorber.

Different spaces in a building often have very different heating and cooling needs. For example, a system, described in U.S. Pat. No. 8,171,746, provides separate latent and sensible cooling in one of the conditioned spaces. The terminal units in the occupied spaces are able to either perform heating or cooling, and either humidification or dehumidification, in each space, independently of the requirements of other spaces in the same building.

While various architectures for a space conditioning system can provide the desired operating conditions, the constraints placed on the system operation by the architecture may cause many of these systems to operate inefficiently. It is therefore desired to provide a space conditioning system that can independently compensate for the latent and sensible loads in a multiplicity of spaces, and can be operated in a manner that optimizes the energy efficiency of the system.

SUMMARY OF THE INVENTION

Systems using liquid desiccants rely on the physical process of absorption and can be used to concurrently cool and dehumidify the air and improve the comfort of occupants in a building. A liquid desiccant-based space conditioning system can include one liquid desiccant conditioning unit and multiple space conditioning units. The liquid desiccant conditioning unit is usually arranged outdoors for changing the temperature and the concentration of the liquid desiccant. The multiple space conditioning units are arranged in enclosed spaces, such as rooms in the building, for controlling the environment in those spaces. The liquid desiccant processed by a space conditioning unit is returned to the liquid desiccant conditioning unit for reconditioning.

Some embodiments of the invention are based on an observation that the temperature and concentration of the liquid desiccant are largely independent from each other over a range of operating conditions. For example, cool and concentrated liquid desiccant can first be used to reduce the temperature in one room by a sensible heat exchange process. The resulting liquid desiccant, which is now warm but still concentrated, can be reused to absorb moisture in another room that is humid but has an acceptable temperature. It was further observed that less energy is required to change the temperature of the liquid desiccant than the concentration of the liquid desiccant. Thus, the temperature of the concentrated liquid desiccant can be changed, e.g., locally, to perform both temperature and moisture control in another room.

Based on the above, it was realized that it can be advantageous to circulate the liquid desiccant through multiple space conditioning units without changing the concentration of the liquid desiccant, i.e., before the liquid desiccant is returned back to the liquid desiccant conditioning unit for reconditioning. Because the operations of the liquid desiccant conditioning unit are the most energy demanding, the reuse of the liquid desiccant increases the energy efficiency of the liquid desiccant-based system for temperature and humidity control.

Accordingly, one embodiment discloses a branch controller of a system for temperature and humidity control. The system can include a liquid desiccant conditioning unit for changing a temperature and a concentration of a liquid desiccant and a plurality of space conditioning units for controlling the temperature and the humidity in a plurality of spaces using the liquid desiccant.

The branch controller of this embodiment includes a fluid control system for controlling a flow of the liquid desiccant in an arrangement of channels forming a first path for exchanging the liquid desiccant between the liquid desiccant conditioning unit and at least a first space conditioning unit and a second path for directing the liquid desiccant received from the first space conditioning unit to a second space conditioning unit; and a processor for comparing operational conditions of the first space conditioning unit and the second space conditioning unit, for selecting between the first path and the second path based on the comparison and for commanding the fluid control system to control the flow of the liquid desiccant according to the selected path.

Another embodiment discloses a system for temperature and humidity control. The system includes a liquid desiccant conditioning unit for changing a temperature and a concentration of a liquid desiccant; a first space conditioning unit for controlling a first environment using the liquid desiccant; a second space conditioning unit for controlling a second environment using the liquid desiccant, wherein the liquid desiccant conditioning unit, the first space conditioning unit and the second space conditioning unit are interconnected with an arrangement of channels suitable for transporting the liquid desiccant; and a branch controller for channeling the liquid desiccant received from the first space conditioning unit to either the liquid desiccant conditioning unit or the second space conditioning unit.

Yet another embodiment discloses a method for controlling temperature and humidity in multiple spaces using a liquid desiccant. The method includes comparing an operational condition of a first space conditioning unit arranged for controlling a first environment using the liquid desiccant with an operational condition of a second space conditioning unit arranged for controlling a second environment using the liquid desiccant; selecting, in response to the comparison, between a first path for directing the liquid desiccant received from the first space conditioning unit to a liquid desiccant conditioning unit and a second path for directing the liquid desiccant received from the first space conditioning unit to a second space conditioning unit; and directing a flow of the liquid desiccant according to the selected path.

DETAILED DESCRIPTION OF PREFERRED EMBODIMENT

Figure 1:
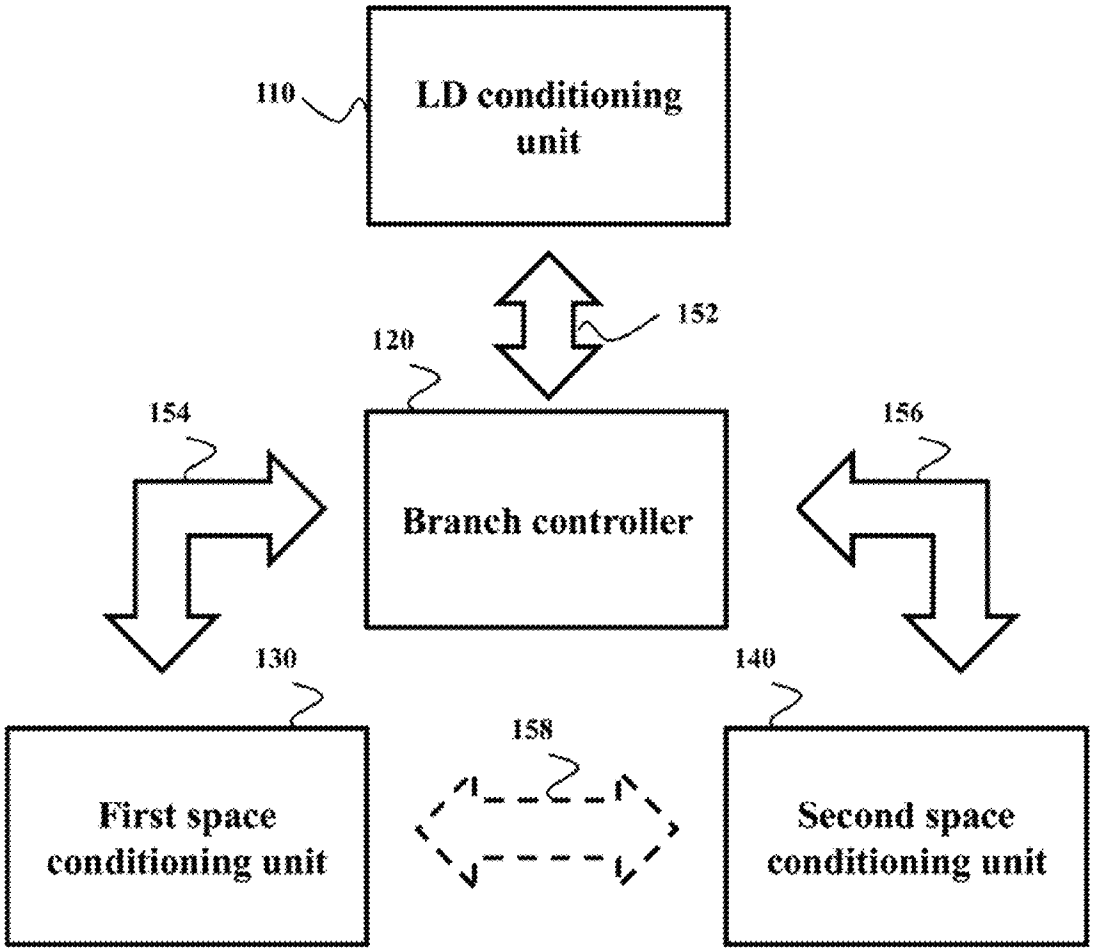
FIG. 1 is a block diagram of a system for temperature and humidity control according to one embodiment of the invention.

FIG. 1 shows a block diagram of a system for temperature and humidity control according to one embodiment of the invention. The system includes a liquid desiccant (LD) conditioning unit 110 for changing a temperature and a concentration of a liquid desiccant. For example, the liquid desiccant conditioning unit can include a regenerator and multiple heat exchangers for changing the temperature and the concentration of the liquid desiccant (not shown). The system also includes multiple space conditioning units for controlling indoor environments using the liquid desiccant. For example, the system can include a first space conditioning unit 130 for controlling a first environment and a second space conditioning unit 140 for controlling a second environment. The first and the second environments are usually physically separated from each other, e.g., in separate rooms in a building. The system also includes a branch controller 120 for redirecting the liquid desiccant received from the first space conditioning unit to either the liquid desiccant conditioning unit or the second space conditioning unit.

In the embodiment of FIG. 1, the liquid desiccant conditioning unit, the first space conditioning unit and the second space conditioning unit are interconnected with an arrangement of channels, e.g., the channels 152, 154, 156, and 158, suitable for transporting the liquid desiccant. In some embodiments, the arrangement of channels includes at least one channel connecting the first and the second space conditioning units, such that the branch controller 120 can direct the liquid desiccant received from the first space conditioning unit to the second space conditioning unit. For example, the first and the second space conditioning units can be connected directly using a channel 158. Additionally or alternatively, the first and the second space conditioning units can be connected indirectly through the branch controller 120, e.g., via channels 154 and 156.

Such interconnection allows the branch controller to control a flow of the liquid desiccant in various directions. For example, the arrangement of channels can form a first path for exchanging the liquid desiccant between the liquid desiccant conditioning unit 110 and at least the first space conditioning unit 130. The arrangement of channels can also form a second path for directing the liquid desiccant received from the first space conditioning unit 130 to the second space conditioning unit 140. For example, the first path can be formed by the channels 154 and 152, and the second path can be formed by the channels 154 and 156. The arrangement of channels can form other pathways, such as a path for exchanging the liquid desiccant between the liquid desiccant conditioning unit 110 and the second space conditioning unit 140. Additionally or alternatively, the channels may also be configured so that the concentrated desiccant entering the branch controller 120 through channels 152 can be mixed with the dilute desiccant returning from a first space conditioning unit 130 via channel 154. This mixed desiccant could then be directed to a second space conditioning unit.

Figure 2:
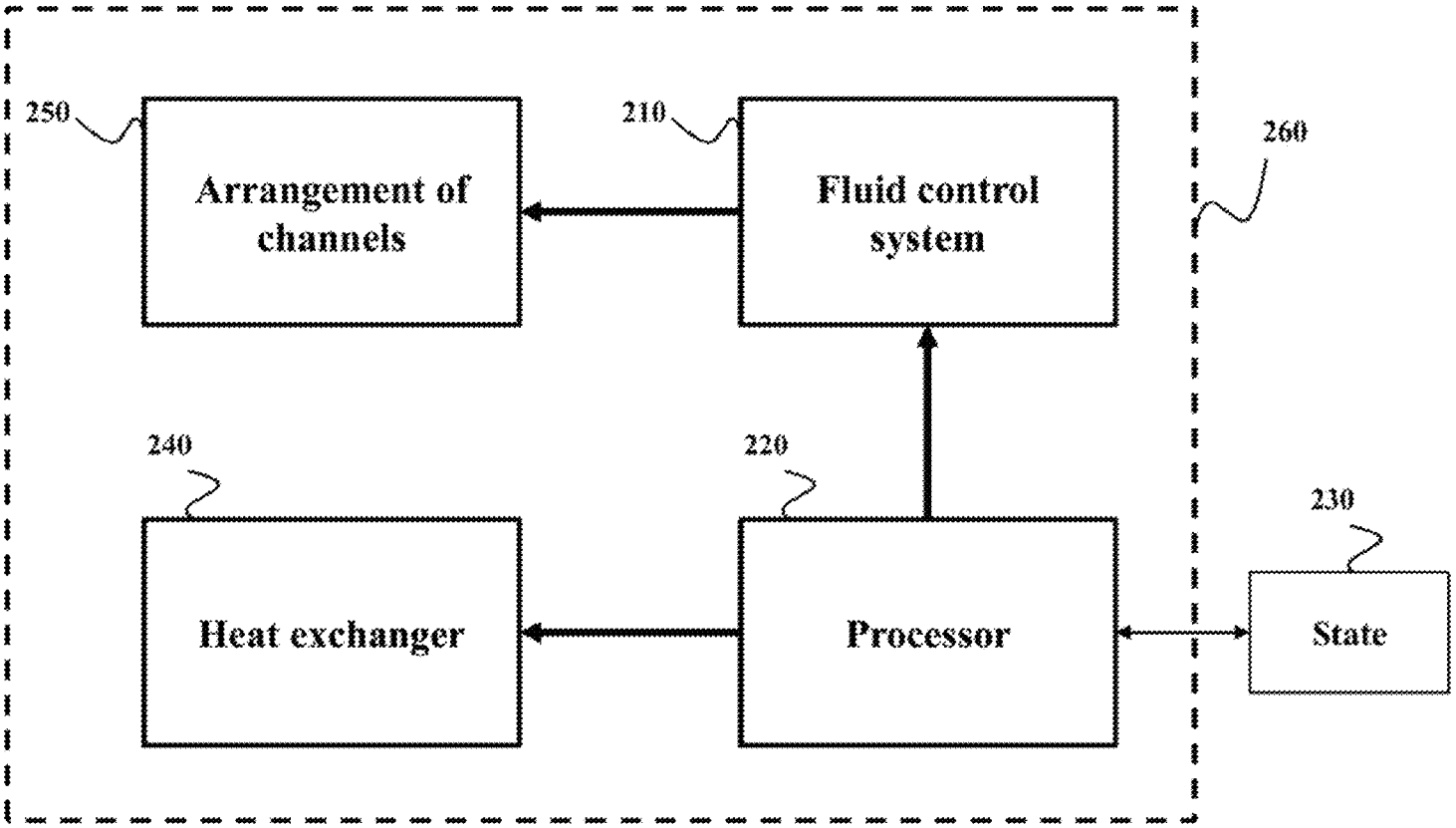
FIG. 2 is a block diagram of a branch controller according to one embodiment of the invention.

FIG. 2 shows a block diagram of a branch controller 120 according to one embodiment of the invention. The branch controller includes a fluid control system 210 for controlling a flow of the liquid desiccant in the arrangement of channels 250. The branch controller also includes a processor 220 for determining a state 230 of the liquid desiccant returning from the a space conditioning unit, selecting between the choices of regenerating or reusing the desiccant received from the first space conditioning unit based on the state of the desiccant, and commanding the fluid control system to control the flow of the liquid desiccant according to the selected use of the desiccant.

The branch controller can redirect the liquid desiccant received from the first space conditioning unit to the second space conditioning unit without changing the concentration of the liquid desiccant. Such redirection enables an increase in the energy efficiency of the system by using the liquid desiccant in multiple space conditioning units 130 and 140 before the liquid desiccant is reconditioned by the liquid desiccant conditioning unit 110.

In one embodiment, the branch controller is implemented as a standalone system and includes a housing 260 enclosing the processor and at least part of the fluid control system and the arrangement of channels. In alternative embodiment, the branch controller is integrated with the liquid desiccant conditioning unit.

In some embodiments, the branch controller redirects the liquid desiccant without changing both a temperature and a concentration of the liquid desiccant. In alternative embodiments, the branch controller changes the temperature of the liquid desiccant before redirecting the flow of the liquid desiccant between the space conditioning units. In those embodiments, the branch controller can include at least one heat exchanger 240 for changing a temperature of the liquid desiccant received from the first space conditioning unit before redirecting the flow of the liquid desiccant in the second direction. For example, the branch controller can include a plurality of heat exchangers including one heat exchanger for each space conditioning unit.

In some embodiments, the state 230 of the liquid includes at least one of a temperature and a concentration of the liquid desiccant returning from the first space conditioning unit. The state 230 can be measured directly using appropriate sensors, e.g., temperature and concentration sensors, after the liquid desiccant is received, or indirectly by evaluating the operational conditions, e.g., temperature and humidity, of the first space conditioning unit or by comparing the operational conditions of the first and the second space conditioning units.

Figure 3:
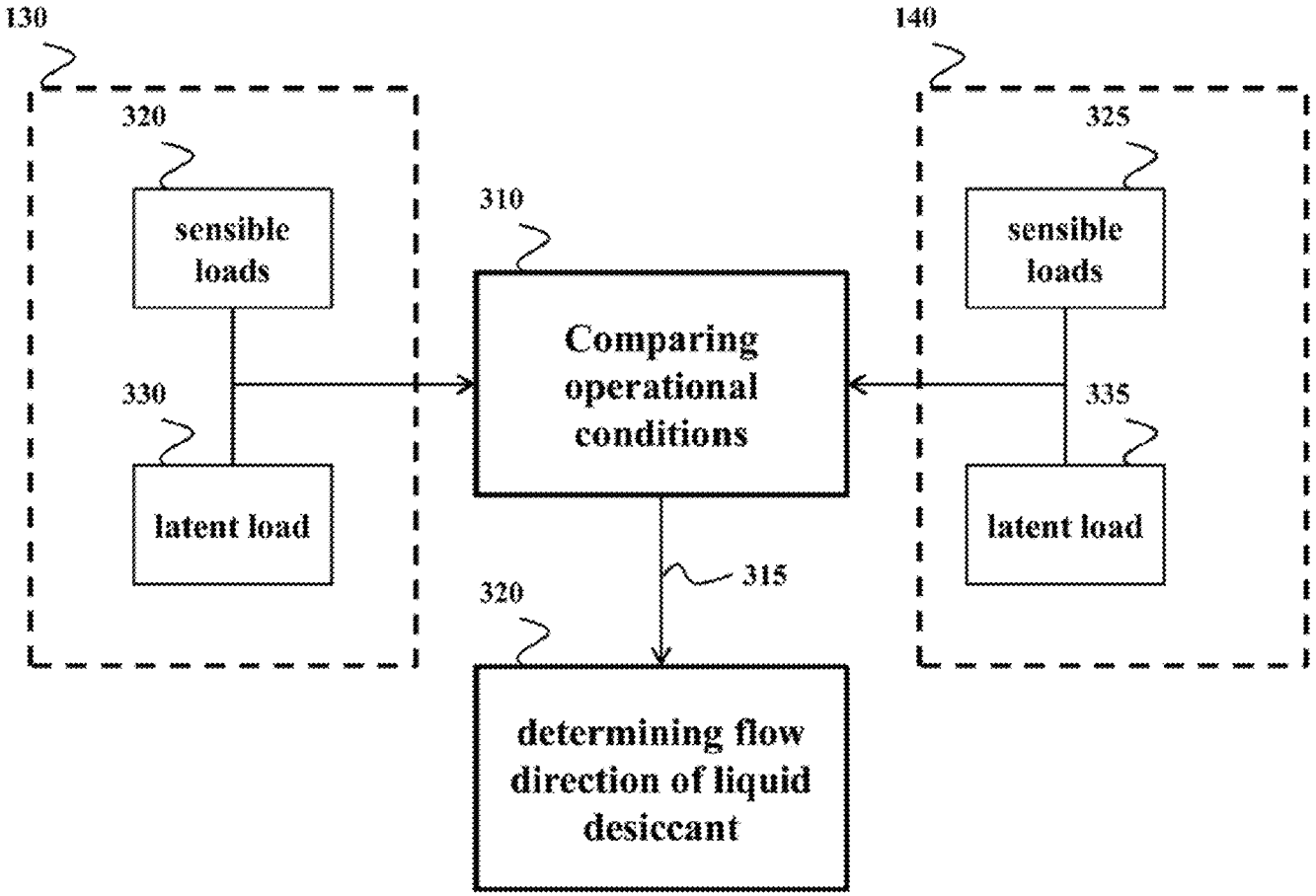
FIG. 3 is a block diagram of a method for determining a direction of a flow of the liquid desiccant.

FIG. 3 shows a block diagram of a method for determining a direction of a flow of the liquid desiccant, including selecting between the first and the second paths of the flow. In some embodiments, the processor 220 compares 310 operational conditions of the first space conditioning unit 130 and the second space conditioning unit 140. The direction of a flow of the liquid desiccant is determined 320 based on a result 315 of the comparison. Some examples of possible directions are described below.

The operational conditions can be measured by various sensors installed throughout the system for temperature and humidity control. For example, the sensors can be arranged at the space conditioning units and/or at the spaces controlled by the space conditioning units. Additionally or alternatively, the operational conditions can be inferred, at least in part, by the branch controller based on the measurements of the state of the liquid desiccant received from a space conditioning unit.

In some embodiments, the latent loads 330 and 335 of the first and the second space conditioning units are compared 310 to determine the operational conditions. Some embodiments also compare sensible loads 320 and 325 of the first and the second space conditioning units. As used herein, a sensible load of each space conditioning unit includes a temperature difference between a current and a requested temperature in a space controlled by each space conditioning unit. A latent load of each space conditioning unit includes a humidity difference between a current and a requested humidity in the space controlled by each space conditioning unit.

In some embodiments, the branch controller adjusts the temperature of multiple streams of concentrated liquid desiccant to meet both the sensible and latent loads of the multiplicity of spaces. The branch controller can also include a processor for determining if the liquid desiccant returning from one space still has a sufficiently high concentration for dehumidifying another space before being regenerated by the LD conditioning unit 110.

Figure 4:
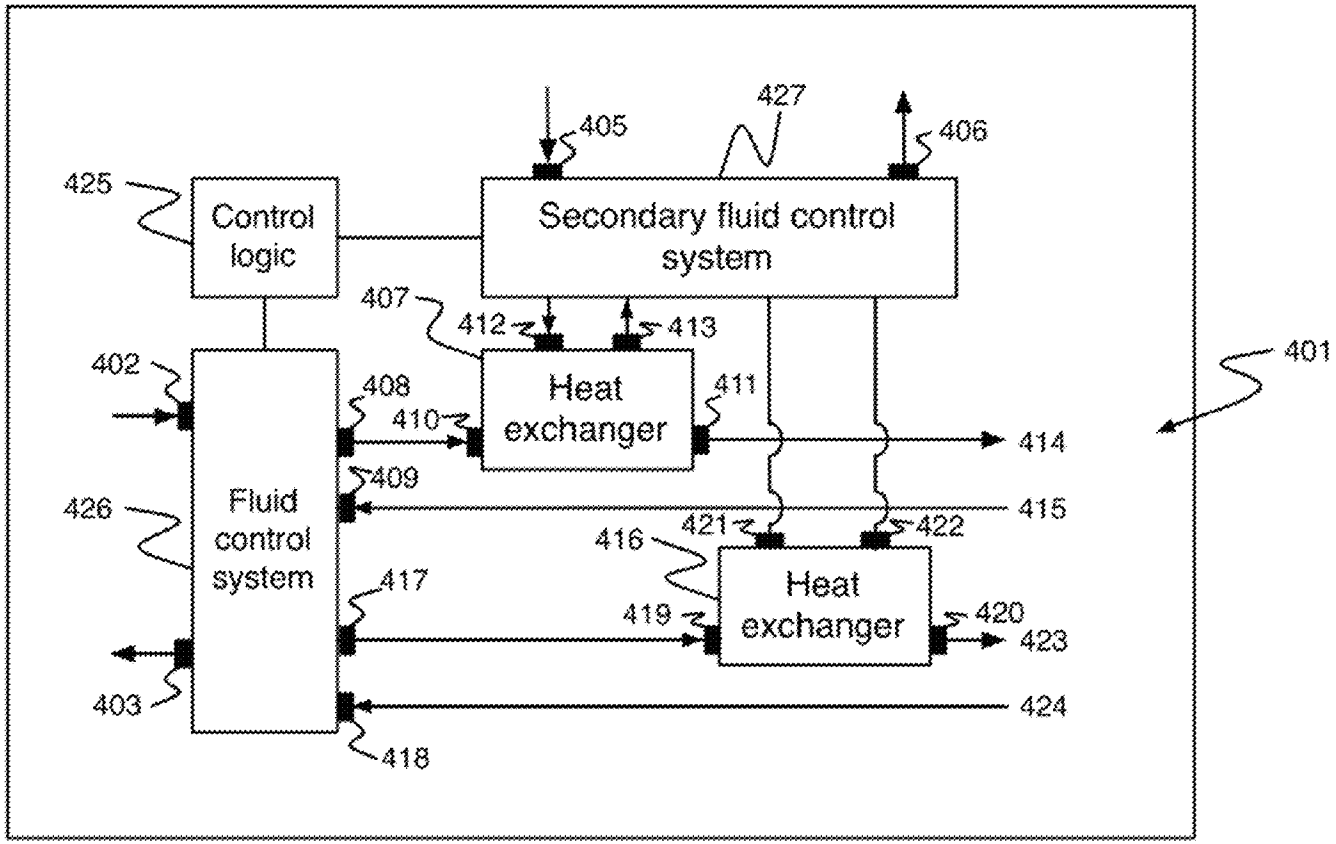
FIG. 4 is a schematic of the branch controller according to one embodiment of the invention.

FIG. 4 shows a block diagram of a branch controller 401 according to one embodiment of the invention. For clarity, this embodiment is described for two space conditioning units, but the embodiment can be extended to operate with any number of space conditioning units. The branch controller includes a fluid control system 426 that controls the path and flow rates of the liquid desiccant; a secondary fluid control system 427 that controls the flow rates of the secondary fluid; two heat exchangers 407, and 416 that adjust the temperature of the liquid desiccant to meet the requirements of the space loads; and a processor implementing a control logic assembly 425 that regulates the fluid flow rates and the valve positions depending on measurements of the conditioned space and the state of the fluids at various points in the branch controller.

In this embodiment, the fluid control system 426 is implemented using an arrangement of pipes, pumps and various valves strategically arranged to direct the flow of the liquid desiccant. During the operation of the branch controller 401, the concentrated liquid desiccant enters the fluid control system 426 via the inlet pipe 402. The control logic assembly 425 selects the path for the liquid desiccant to take to the space conditioning units. In the case that the control logic assembly determines that concentrated liquid desiccant needs to flow to both heat exchangers 407 and 416, the valves and flow rates are configured such that the concentrated liquid desiccant flows out of the fluid control system 410 through port 408 and 417.

A secondary fluid enters the secondary fluid control system 427 through the inlet port 405. This secondary fluid control system controls the flow rates such that the state of the liquid desiccant exiting the branch controller is sufficient to meet the sensible loads of the spaces. The secondary fluid exits the secondary fluid control system via port 412 and enters heat exchanger 407. The temperatures of the secondary fluid and the concentrated liquid desiccant are changed while interacting thermally in the heat exchanger 407. The state of the liquid desiccant exiting the heat exchanger via port 411 is sufficient to meet either one or a combination of the sensible and the latent loads of the space where the first space conditioning unit is located. The cooled concentrated liquid desiccant then exits the first heat exchanger 407 via the liquid desiccant outlet port 411. The warmed secondary fluid exits the first heat exchanger 407 via the secondary fluid outlet port 413, and is returned to the secondary fluid flow control assembly. The conditioned liquid desiccant exits the branch controller via port 414 to travel to the first space conditioning unit, where the conditioned liquid desiccant is both diluted and warmed by the space loads. The dilute and warm liquid desiccant returns from the space conditioning unit to the branch controller via port 415 and enters the fluid control system 426 via port 409.

In some situations, e.g., determined based on the state 230 of the liquid desiccant, the concentrated liquid desiccant is required by both space conditioning units. Hence, the fluid control system 426 can route a portion of the concentrated liquid desiccant from the inlet port 402 to port 417 for the second heat exchanger. A portion of secondary fluid is also routed from the inlet port 405 of the secondary fluid control system 427 to inlet port 421 of the second heat exchanger 416. The concentrated liquid desiccant and the secondary fluid interact thermally in the second heat exchanger 416, resulting in cooled concentrated liquid desiccant exiting the second heat exchanger from port 420 and warmed secondary fluid exiting the second heat exchanger via port 422. This cooled concentrated liquid desiccant then exits the branch controller via port 423, and flows to the second space conditioning unit and conditions the space. The dilute and warm liquid desiccant returning from the space conditioning unit enters the branch controller through port 424, and is routed to the fluid control system 426 via port 418. In the case that space loads are all high enough that the returning liquid desiccant must be regenerated before reuse, this return liquid desiccant is mixed and exits the branch controller via port 403 for regeneration. Similarly, the secondary fluid returning from the heat exchangers is mixed together at the secondary fluid control system 427 and exits the branch controller via port 406 to be cooled for reuse.

In an alternative situation, wherein the control logic assembly 425 determines that a state of the returning liquid desiccant has a sufficiently high concentration to be reused before being regenerated, the fluid control system 426 is set such that the liquid desiccant returned from the first space conditioning unit is then directed toward the second heat exchanger 416, where the liquid desiccant is conditioned by the secondary fluid entering port 421 to have a state adequate to meet the space loads in the second space, and the reconditioned liquid desiccant exits the branch controller via port 423 to travel to the second space conditioning unit. The dilute liquid desiccant returning to the branch controller from the second space conditioning unit via port 424 is processed by the fluid control system 426 and returned to the liquid desiccant conditioning unit from the branch controller via port 403 to be regenerated. The liquid desiccant is thus used more effectively before the liquid desiccant is regenerated, increasing the energy efficiency of the overall system.

Figure 5:
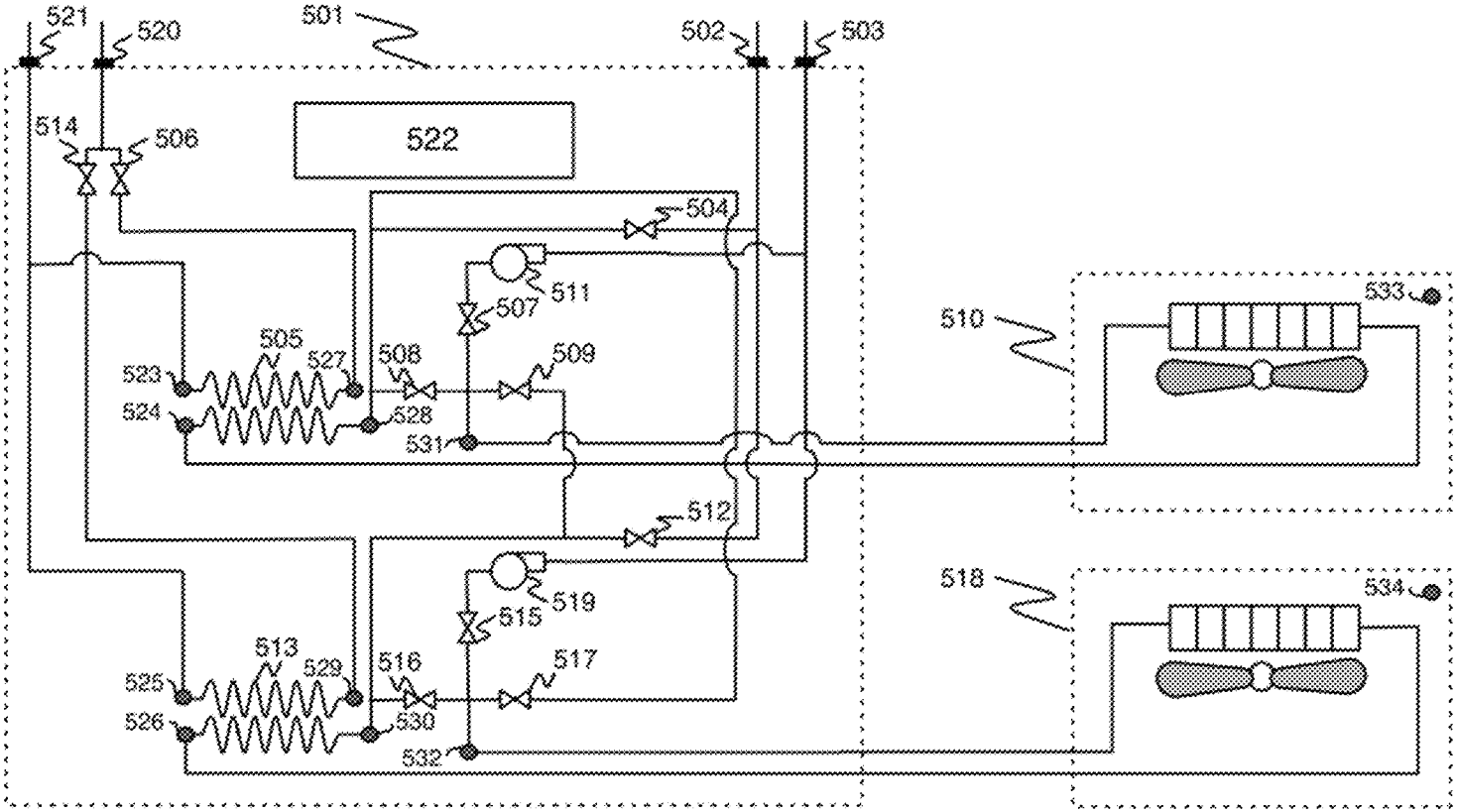
FIG. 5 is a schematic implementation of the branch controller of FIG. 4.

FIG. 5 shows a representative implementation of a branch controller 501 designed to be connected to a first space conditioning unit 510 and a second space conditioning unit 518. The principles of the operation of the branch controller 501 are first described for the case when both space conditioning units operating in parallel, i.e., the branch controller directs the liquid desiccant received from the first space conditioning unit back to the liquid desiccant conditioning unit.

The branch controller 501 first receives concentrated liquid desiccant from the inlet pipe 502. The control logic assembly 522, having determined that the concentrated liquid desiccant must be circulated to both space conditioning units, opens valves 504, 507, 512, and 515, and closes valves 508, 509, 516, 517. Concurrently, cool secondary fluid enters the branch controller via the inlet pipe 520 and flows to the first heat exchanger 505 via the valve 506, which is adjusted by the control logic assembly 522 to manage the flow.

The liquid desiccant and the secondary fluid both flow through the first heat exchanger 505 and interact thermally, so that the state of the liquid desiccant that enters the first space conditioning unit 510 is able to condition the space in a manner appropriate to the load. The warm and dilute liquid desiccant returns from the first space conditioning unit 510 and passes through the valve 507 and the pump 511, which is controlled by the control logic assembly to regulate the flow rate. This liquid desiccant returned from the first space conditioning unit is then mixed with the warm and dilute liquid desiccant returning from the second space conditioning unit 518, and the combination of the streams exits the branch controller via pipe 503 to be regenerated. The warmed secondary fluid used to cool down the concentrated liquid desiccant is mixed with the secondary fluid returning from the second heat exchanger, and then is exhausted from the branch controller via pipe 521.

The second branch in the branch controller operates analogously to the first. With the set of the valves in the branch controller set in the aforementioned states, the concentrated liquid desiccant enters the second heat exchanger 513 after passing through valve 512 and is cooled down by the secondary fluid, which has similarly passed through valve 514. The cool concentrated liquid desiccant then passes through the second space conditioning unit 518, conditions the space and then returns to the branch controller, having been warmed and diluted. This return liquid desiccant then passes through valve 515 and the second pump 519, and is returned to the liquid desiccant conditioning unit via pipe 503.

The control logic assembly 522 operates the collection of pumps 511, and 519 and the valves 504, 506, 507, 508, 509, 512, 514, 515, 516, and 517 to control the flow paths and flow rates of the liquid desiccant and the secondary fluid to meet the specified space conditions and maintain high system-wide energy efficiency. The assembly 522 determines the flow paths and flow rates needed to meet the specified objectives on the basis of sensor data that is collected from the system.

In FIG. 5, some of the sensors are shown by filled circles. For example, the system can be operatively connected with sensors 523-530 and 533-534. For example, data on the inlet 528 and outlet 524 temperatures of the concentrated liquid desiccant and the inlet 527 and outlet 523 temperatures of the secondary fluid can provide information about the state of the secondary fluid as well as the state of the fluid entering the space conditioning unit. Temperature and humidity measurements in the first conditioned space 533 and in the second conditioned space 534 can also be used to compare the sensible and latent space loads. The control logic assembly can also determine the current position of all of the valves and the pumps. Other arrangements of sensors are possible.

When the control logic determines that the liquid desiccant can be reused, the branch controller directs the liquid desiccant along the second direction and adjusts the position of the valves accordingly. For example, when the control logic assembly determines that the liquid desiccant should flow first through the first space conditioning unit 510 then through the second space conditioning unit 518 along the second direction and then back to be regenerated, the control logic assembly directs the valves 504, 509, 515 to open, and valves 507, 508, 512, 516, and 517 to close. Then the pump 511 is turned off, and the pump 519 is activated to produce the pressure differential to provide the required flow rate.

Figure 6:
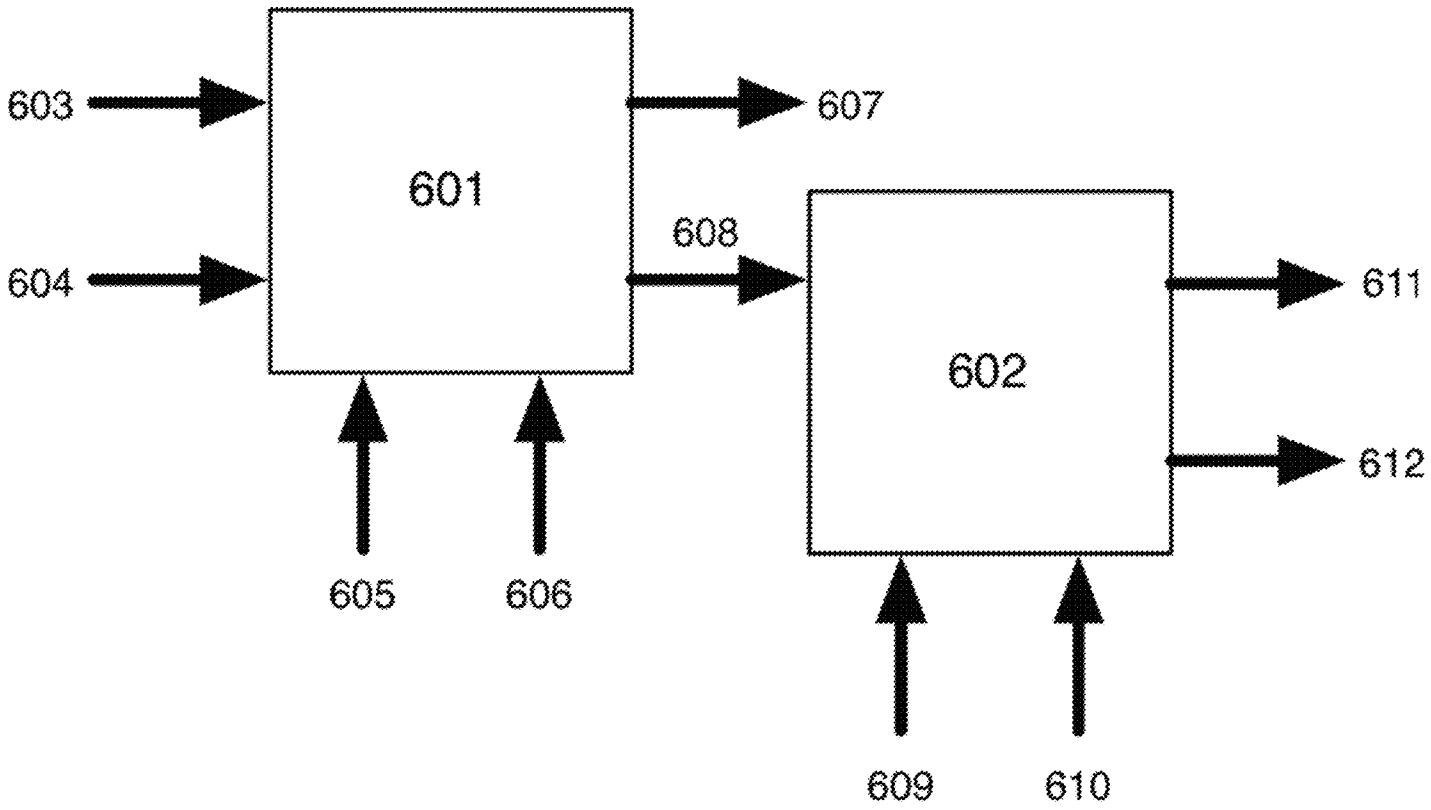
FIG. 6 is a high-level block diagram of a control logic assembly operating the branch controller according to one embodiment.

FIG. 6 illustrates a high-level block diagram of the control logic assembly 522 operating the branch controller according to one embodiment. This block diagram separates the control method into two steps. The first block 601 inputs a setpoint 603 specified for the temperature and humidity of the first space and a setpoint 604 specified for the temperature and humidity of the second space. The block 601 also inputs the measurements 605 and 606 of the current temperature and humidity for the first space and the second space, respectively. The temperature of the liquid desiccant is adjusted with the heat exchangers to meet the sensible load of the room, and the control logic in this first block 601 provides a set of valve command outputs 607 to change the position of the valves in the secondary fluid loops so that the temperature of the liquid desiccant exiting the branch controller will be able to meet the sensible loads of the rooms.

The block 601 also determines a set of target concentration differences ($\Delta x_i$) 608 for each room. For example, given a target humidity for the first room and a specific inlet concentration of liquid desiccant, a target concentration difference can be determined as a control input that allows the room to attain the desired humidity given the current latent load.

This set of target concentration differences is then input to the second control block 602. The block 602 also receives input estimates 609 and 610 of the current concentration differences for the first room and the second room, respectively. The control logic then determines the valve positions 611 and the pump speeds 612 to achieve the target concentration differences for both of the space conditioning units.

There are a large number of operational parameters of the branch controller, such as the set of valve positions and pump speeds that must be determined by the control logic assembly. This assembly facilitates the efficient operation of the overall system through the proper selection of these inputs.

Figure 7:
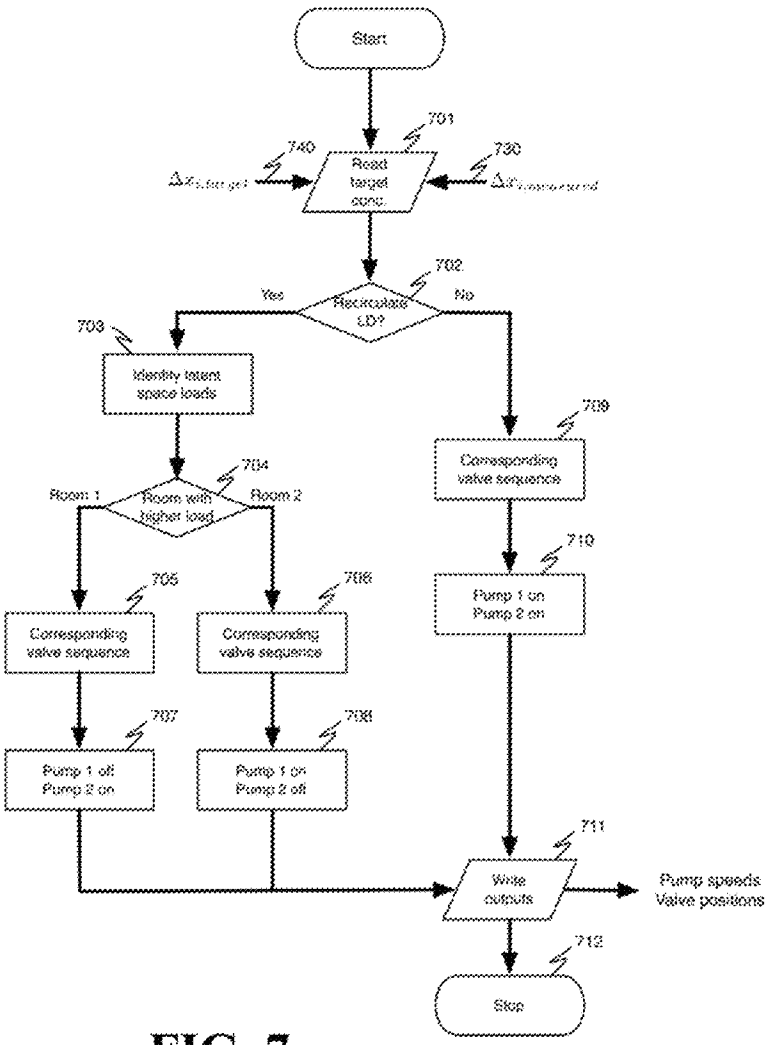
FIG. 7 is a flowchart of a method for controlling an operation of the system according to one embodiment of the invention.

FIG. 7 illustrates a flowchart of a method for controlling an operation of the system according to one embodiment of the invention. This flowchart illustrates one model of the control logic needed to operate the branch controller for the system when the system is operating to provide cooling and dehumidification capabilities to the space conditioning units. The method of FIG. 7 can be implemented by a second block 602 of the control logic assembly of FIG. 6. This logic implements the capability of the overall system to meet the latent load of the space, as the sensible cooling capabilities of the system are coupled to the control of the heat exchangers in the branch controller.

At the beginning of each control cycle, the control assembly reads 701 the measured 730 and target 740 concentration differences and assesses 702 whether it is possible and efficient to meet the latent loads in both spaces from a single stream of concentrated liquid desiccant, or if it is necessary to split the inlet stream of liquid desiccant into two parallel streams that travel to both space conditioning units and then merge afterwards. If the latent loads of both spaces can be met by circulating the liquid desiccant through one space and reusing the same liquid desiccant in the second space, then the liquid desiccant is recirculated.

If the liquid desiccant can be circulated through one space conditioning unit and directed to the other before regeneration, then the control logic assembly determines 703 which room 704 requires the higher concentration difference. The control logic assembly commands 705 and 706 to arrange sequences the valves such that the concentrated liquid desiccant flows into the space with the higher concentration difference first. The control logic assembly also activates 707 and 708 the pumps so that the operational pump is downstream of the last space conditioning unit in the flow path.

In this way, the processor of the branch controller can determine which space conditioning unit is the first, and which one is the second. For example, the processor compares latent loads of the space conditioning units and selects the space conditioning unit with the higher latent load as the first space conditioning unit. The processor commands the fluid control system to direct the liquid desiccant to the first space conditioning unit having higher latent load than a latent load of the second space conditioning unit, and then to direct the liquid desiccant to the second space conditioning unit.

If the control logic determines 702 that latent loads are such that the liquid desiccant cannot be reused, then the control assembly sequences 709 the valves so that the concentrated liquid desiccant stream flows through each space conditioning unit in parallel, after which their outlet streams merge. The control logic also activates 710 both pumps to provide the required mass flow rate through each space conditioning unit. These pump speed set points and valve position set points are then sent 711 to all of the devices after their computation, completing 712 a single control cycle.

Figure 8:
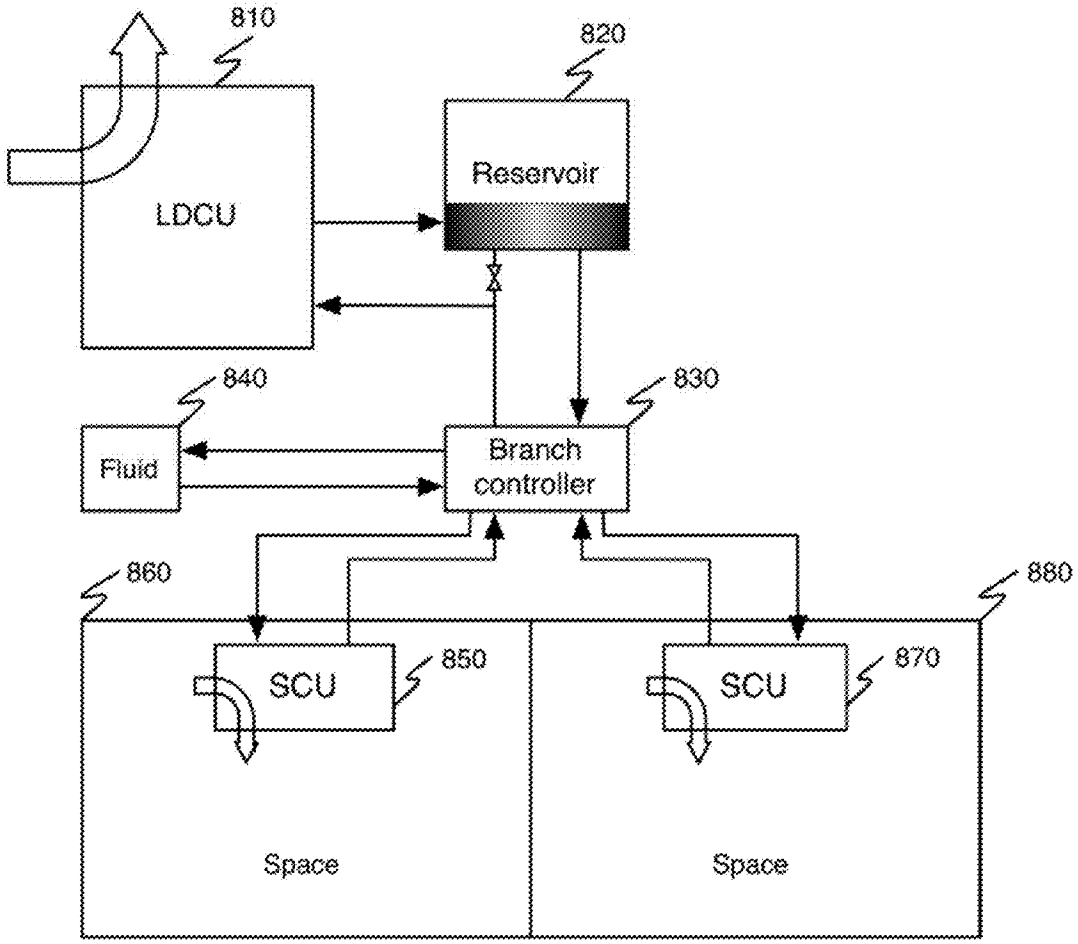
FIG. 8 is a block diagram of a system for temperature and humidity control according to one embodiment of the invention.

FIG. 8 shows a block diagram of a system for temperature and humidity control used for either cooling and dehumidification, or heating and humidification. The branch controller of various embodiments can be used as a component of this system. For simplicity, the system is described as operating in a cooling and dehumidifying mode. A liquid desiccant conditioning unit 810 takes the warm dilute liquid desiccant as an input, concentrates and cools the liquid desiccant, and optionally outputs the cooled concentrated liquid desiccant into a concentrated storage reservoir 820.

The storage reservoir 820 decouples the requirements of the space conditioning units from the regeneration capacity of the liquid desiccant conditioning unit, allowing a temporary mismatch between the rates of regeneration and absorption of the liquid desiccant. The flow rates of the liquid desiccant through the various space conditioning units can vary based upon the conditioning requirements of the space. This variation can cause the sum of the liquid desiccant flows to the space conditioning units to differ from the liquid desiccant solution flow through the liquid desiccant conditioning unit. The storage reservoir 820 allows the system to have more flexibility in separately modulating the liquid desiccant flow through the space conditioning units and the liquid desiccant conditioning unit so that a high energy efficiency of the system can be maintained.

The storage reservoir also affords other benefits. For example, electric utilities are beginning to use pricing schemes in which the price of electricity varies throughout the day. One embodiment regenerates and stores the liquid desiccant in concentrated form when electricity is inexpensive, and then uses the liquid desiccant when the price of electricity increases.

The concentrated liquid desiccant passes from the reservoir 820 to the branch controller 830, which determines the path that the liquid desiccant takes through the space conditioning units 850 and 870. A source of cool secondary fluid 840 is also connected to the branch controller 830. This source of secondary fluid 840 could be a pre-existing chilled water system that is installed in the building, which can serve as a heat rejection source without the need for installing a separate cooling system. The branch controller is also connected to the set of space conditioning units 850 and 870, which are functioning as absorbers. These space conditioning units are each located in independent spaces 860 and 880, for which both the temperature and humidity setpoints, as well as the sensible and latent loads, could potentially differ.

The block arrows drawn through the space conditioning units indicates airflow through the space conditioning unit. After the liquid desiccant passes through each space conditioning unit in absorbing mode, the liquid desiccant returns to the branch controller and then to the regeneration unit. The system can also include an adjustable valve that connects the return line to the storage reservoir 820 to ensure that a minimum flow rate of liquid desiccant through the regenerator during operation can always be satisfied.

Figure 9:
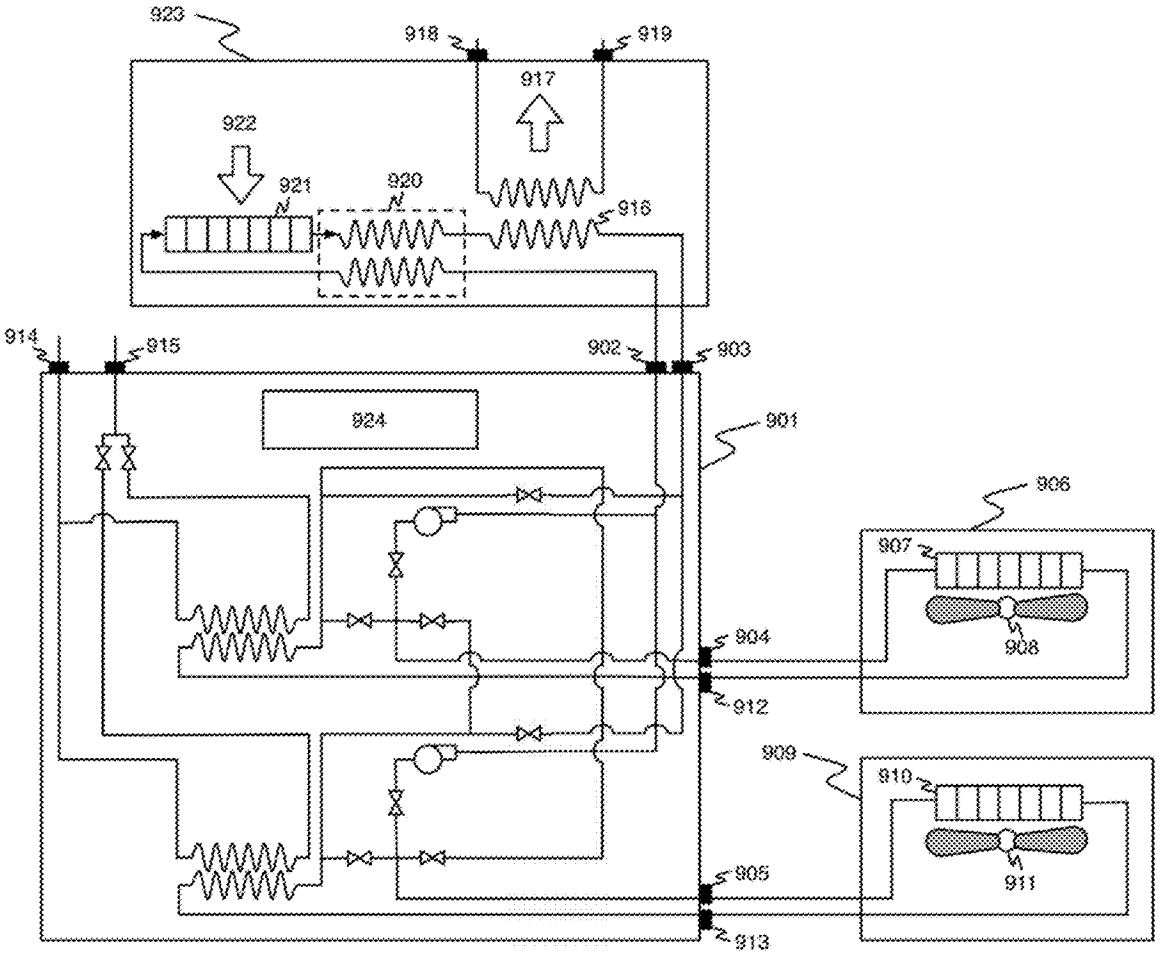
FIG. 9 is a component-level diagram of the system of FIG. 8.

FIG. 9 shows a component-level diagram of the system for temperature and humidity control of FIG. 8. When the simultaneous cooling and dehumidification in both space conditioning units is required, the concentrated liquid desiccant enters the branch controller 901 through the inlet pipe 903 and then passes through the set of valves corresponding to this flow configuration.

The control logic assembly 925 determines the sequence of valve positions for the flow of the liquid desiccant and also determines the valve positions for the secondary fluid path so that the temperature of the liquid desiccant entering the space conditioning units 906 and 909 provides the required cooling capacity for the sensible load. This secondary fluid enters the branch controller via port 915, and exits it via port 914. The secondary fluid can be obtained from a pre-existing chilled water plant in the building, a ground-source chilled water loop, or a similar source.

After the liquid desiccant enters the space conditioning units, the liquid desiccant passes through heat-and-mass exchangers 907 or 910, which absorb water vapor from the surrounding space and also cool down the surrounding space. Next, the liquid desiccant returns to the branch controller via pipes 912 and 913, passes through the valve system in the branch controller, and exits the branch controller via pipe 902 to enter the liquid desiccant conditioning unit 923. When the warm dilute liquid desiccant enters the liquid desiccant conditioning unit, the liquid desiccant is further warmed at a solution-to-solution heat exchanger 920 by the liquid desiccant that is exiting the regenerator. The liquid desiccant then passes through a regenerator 921, which uses a source of heat 922 causing the water vapor to diffuse out of the liquid desiccant, increasing its concentration. The hot liquid desiccant then passes through the other side of the solution-to-solution heat exchanger 920, after which the liquid desiccant is further cooled by passing through another heat exchanger 916.

Another secondary fluid, which could either be the same as or different from that used for the branch controller, also enters heat exchanger 916 through inlet port 918, and thermally interacts with the hot liquid desiccant, so that the hot liquid desiccant is cooled and the secondary fluid is heated, producing heat 917 that exits the liquid desiccant conditioning unit via port 919 in the form of a higher coolant temperature. The cooled liquid desiccant exits the liquid desiccant conditioning unit 903 and enters the branch controller 901, completing the cycle.

Figure 10:
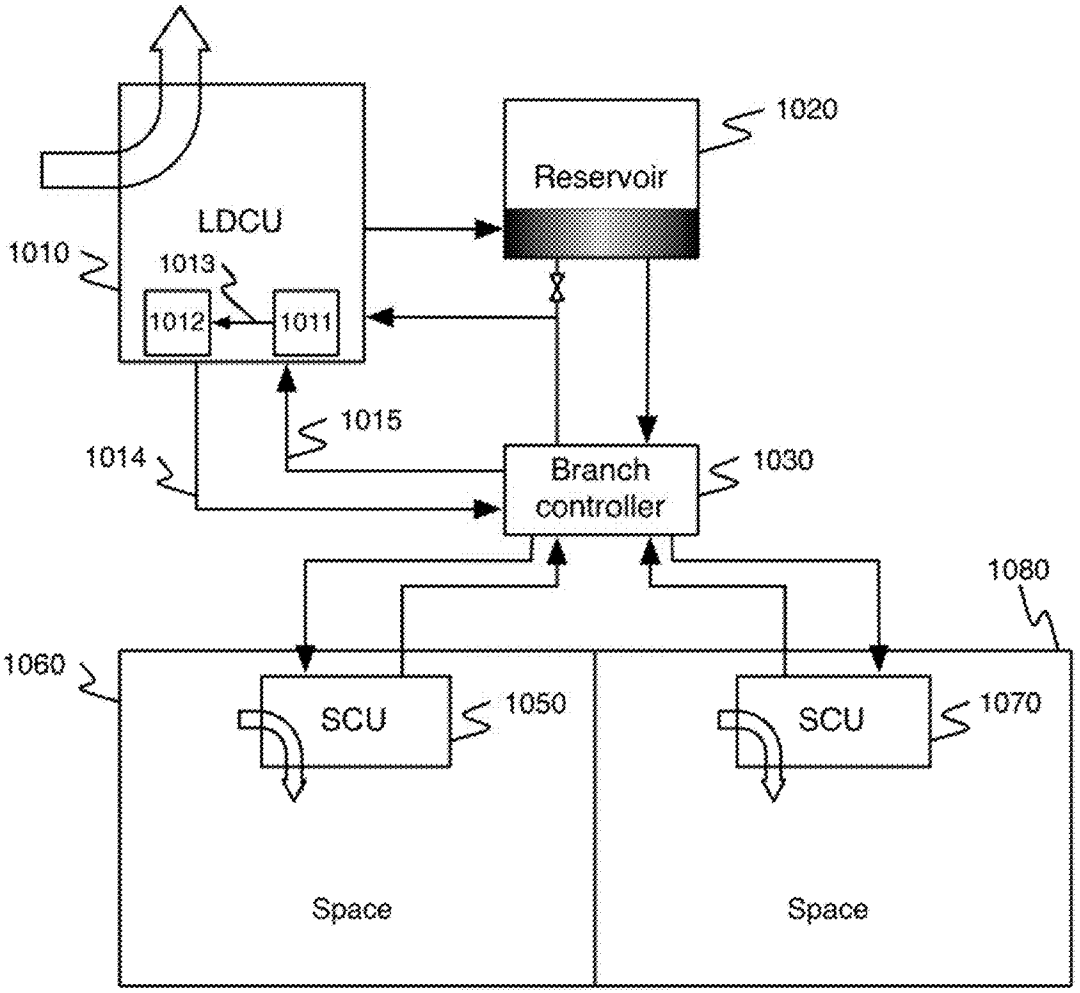
FIG. 10 is a block diagram of a system for temperature and humidity control according to an alternative embodiment of the invention.

FIG. 10 shows a system for temperature and humidity control according to an alternative embodiment of the invention. This system, which is similar to the system illustrated in FIG. 8, includes a liquid desiccant conditioning unit 1010, an optional reservoir 1020, and a branch controller 1030 connected to multiple space conditioning units 1050 and 1070 arranged to change the environments of spaces 1060 and 1080, respectively. However, in this embodiment, the liquid desiccant conditioning unit 1010 uses secondary fluid for reconditioning the liquid desiccant, and the heat exchanger of the branch controller receives at least part of that secondary fluid for a thermal interaction with the liquid desiccant. Hence, the need for a separate source of secondary fluid can be alleviated.

For example, the liquid desiccant conditioning unit 1010 includes a high temperature thermal reservoir and a first heat exchanger 1011 for heating the liquid desiccant in a diluted state using secondary fluid at a high temperature to change the concentration of the liquid desiccant and to reduce a temperature of the secondary fluid to a low temperature. The liquid desiccant conditioning unit 1010 also includes a low temperature thermal reservoir and a second heat exchanger 1012 for cooling the liquid desiccant in a concentrated state using a first part 1013 of the secondary fluid at the low temperature.

In addition, the secondary fluid inlet and outlet ports from the branch controller can be directly connected to the liquid desiccant conditioning unit, rather than to a separate source of secondary fluid. Using those ports, a heat exchanger of the branch controller 1030 can receive a second part 1014 of the secondary fluid at the low temperature from the liquid desiccant conditioning unit for cooling the liquid desiccant received from the first space conditioning unit before redirecting the liquid desiccant to the second space conditioning unit. The second part 1014 is heated during this thermal exchange and is returned to the unit 1010 via pipe 1015 to recondition the liquid desiccant.

Figure 11:
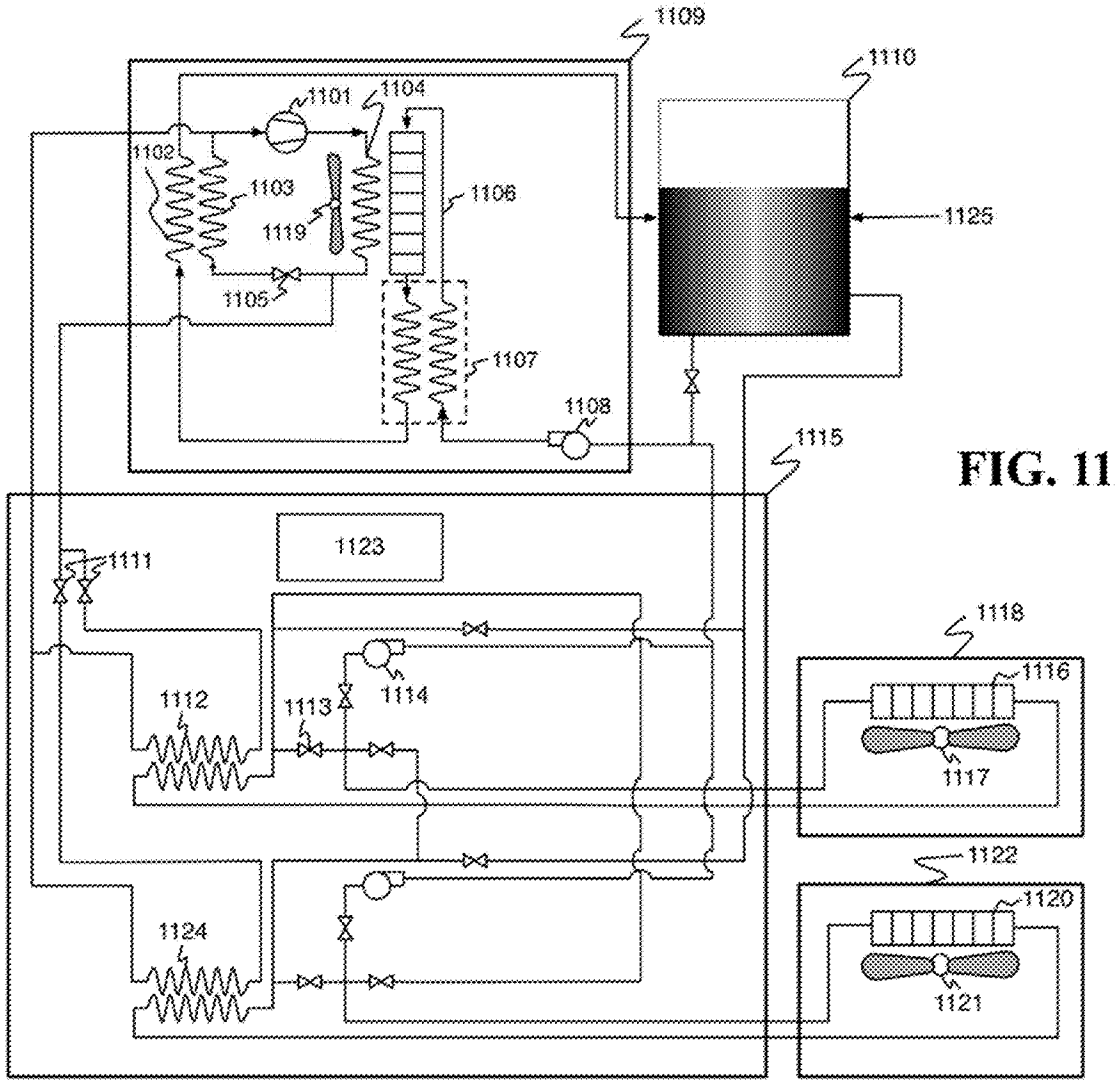
FIG. 11 is a component-level diagram of the system of FIG. 10.

FIG. 11 shows a schematic of a system for temperature and humidity control according to one embodiment of the invention. The system of FIG. 11 includes the liquid desiccant conditioning unit 1109, storage reservoir 1110, branch controller 1115, and two space conditioning units 1117 and 1121 in their respective spaces 1118 and 1122. The liquid desiccant conditioning unit 1109 can include a vapor-compression system that provides heat and cooling to the regeneration process of the liquid desiccant conditioning unit, as well as cooling to the space conditioning units. The vapor-compression system can use a refrigerant, including but not limited to R410A, R32, or R290, as a secondary fluid for the system. The refrigerant is compressed in a compressor 1101 so that the refrigerant is at a high pressure and high temperature. The hot refrigerant passes through heat exchanger 1104 that is thermally coupled to regenerator 1106 so that the liquid desiccant can be heated and concentrated.

After exiting this heat exchanger, the cooler liquid refrigerant is directed toward two distinct branches. In the first branch, the refrigerant passes through expansion valve 1105 and expands to a mixture of vapor and liquid at a lower pressure. The expanded refrigerant then flows into another heat exchanger coil 1103, where the refrigerant evaporates and absorbs thermal energy from the warm liquid desiccant that circulates through the thermally coupled heat exchanger coil 1102. In the other branch, connected to the bottom of condensing refrigerant heat exchanger 1104, the refrigerant passes to the branch controller, where the refrigerant is split into two expansion valves 1111.

The control logic assembly 1123 regulates the position of these two expansion valves 1111 so that the temperature of the liquid desiccant exiting the heat exchangers in the branch controller, e.g., 1112, meets the sensible load of the room. The refrigerant passes through the heat exchangers in branch controller 1115, returns to the liquid desiccant conditioning unit, where the refrigerant merges with the flow from the other heat exchanger, and returns to the compressor. This completes the cycle of the flow of the refrigerant.

In addition to cooling and dehumidification, the system of FIG. 11 can also be used for heating and humidification. In this case, the vapor compression system operates in a heat pump mode so that the refrigerant flows in the opposite direction, causing heat to be provided to the liquid desiccant in the heat exchanger coil 1102 and heat exchangers 1112 and 1124. In addition, the heat-and-mass exchanger 1106 in the liquid desiccant conditioning unit functions as an absorber, while the other heat-and-mass exchangers 1116 and 1120 function as regenerators. When the system is used for heating and humidification, the system must also include a supply of water 1125 to replenish the water in the system that is used in the process of humidifying the occupied spaces.

The above-described embodiments of the present invention can be implemented in any of a variety of ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. Moreover, a processor may be implemented using circuitry in any suitable format.

The various methods or processes outlined herein may also be coded as software that is executable on one or more processors that employ any one of a variety of operating systems or platforms. In addition, such software may be written using any of a number of suitable programming languages and/or programming or scripting tools, and also may be compiled as executable machine language code or intermediate code that is executed on a framework or virtual machine. Typically the functionality of the program modules may be combined or distributed as desired in various embodiments.

The embodiments of the invention may also be embodied as a method, of which an example has been provided. The acts performed as part of the method may be ordered in any suitable way. Accordingly, embodiments may be constructed in which acts are performed in an order different than illustrated, which may include performing some acts simultaneously, even though they are shown as sequential acts in the illustrative embodiments.

Use of ordinal terms such as "first," "second," in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Although the invention has been described by way of examples of preferred embodiments, it is to be understood that various other adaptations and modifications can be made within the spirit and scope of the invention. Therefore, it is the object of the appended claims to cover all such variations and modifications as come within the true spirit and scope of the invention.

We claim:

1. A branch controller of a system for temperature and humidity control, the system including a liquid desiccant conditioning unit for changing a temperature and a concentration of a liquid desiccant and a plurality of space conditioning units for controlling the temperature and the humidity in a plurality of spaces using the liquid desiccant, the branch controller comprising:

a fluid control system for controlling a flow of the liquid desiccant in an arrangement of channels forming a first path for exchanging the liquid desiccant between the liquid desiccant conditioning unit and at least a first space conditioning unit and a second path for directing the liquid desiccant, received by the first space conditioning unit from the liquid desiccant conditioning unit, from the first space conditioning unit to a second space conditioning unit; and a processor for comparing operational conditions of the first space conditioning unit and the second space conditioning unit, for selecting between the first path and the second path based on the comparison and for commanding the fluid control system to control the flow of the liquid desiccant according to the selected path, wherein comparing the operational conditions includes comparing at least one of sensible loads and latent loads of the first and the second space conditioning units, wherein the sensible load of each space conditioning unit includes a temperature difference between a current and a requested temperature in a space controlled by each space conditioning unit, and wherein the latent load of each space conditioning unit includes a humidity difference between a current and a requested humidity in the space controlled by each space conditioning unit.

2. The branch controller of claim 1, further comprising:

a housing enclosing the processor and at least part of the fluid control system.

3. The branch controller of claim 1, wherein comparing the operational conditions includes comparing latent loads of the first and the second space conditioning units.

4. The branch controller of claim 1, wherein the processor determines the sensible load or the latent load of the first space conditioning unit based on the liquid desiccant received from the first space conditioning unit.

5. The branch controller of claim 1, further comprising:

at least one heat exchanger for changing a temperature of the liquid desiccant received from the first space conditioning unit before redirecting the liquid desiccant in the second direction.

6. The branch controller of claim 5, further comprising:

a plurality of heat exchangers including one heat exchanger for each space conditioning unit operatively connected to the branch controller.

7. The branch controller of claim 5, further comprising:

a secondary fluid control system for controlling flow of secondary fluid into the heat exchanger for a thermal interaction with the liquid desiccant.

8. The branch controller of claim 5, wherein the liquid desiccant conditioning unit uses secondary fluid for reconditioning the liquid desiccant, and wherein the heat exchanger receives at least part of the secondary fluid for a thermal interaction with the liquid desiccant.

9. The branch controller of claim 1, wherein the branch controller is mechanically interconnected by the arrangement of channels with the liquid desiccant conditioning unit and the plurality of space conditioning units, wherein the arrangement of channels includes a channel mechanically connecting the first and the second space conditioning units and enabling the branch controller to direct the liquid desiccant received from the first space conditioning unit to the second space conditioning unit using the channel.

10. The branch controller of claim 9, wherein the fluid control system directs the liquid desiccant received from the first space conditioning unit to the second space conditioning unit through the channel without changing the concentration of the liquid desiccant.

11. The branch controller of claim 1, wherein the processor analyzes a concentration of the liquid desiccant received from the first space conditioning unit and, based on a result of the analysis, directs the liquid desiccant to the second space conditioning unit without changing the concentration of the liquid desiccant or, based on a result of the analysis, directs the liquid desiccant to the liquid desiccant conditioning unit for changing the concentration of the liquid desiccant.

12. The branch controller of claim 1, wherein the processor compares latent loads of the first and the second space conditioning units, and wherein the processor, in response to determining that the first space conditioning unit has a higher latent load than a latent load of the second space conditioning unit, directs, first, the liquid desiccant to the first space conditioning unit and directs, second, the liquid desiccant processed by the first space conditioning unit to the second space conditioning unit.

13. A system for temperature and humidity control, comprising:

a liquid desiccant conditioning unit for changing a temperature and a concentration of a liquid desiccant;

a first space conditioning unit for controlling a first environment using the liquid desiccant;

a second space conditioning unit for controlling a second environment using the liquid desiccant, wherein the liquid desiccant conditioning unit, the first space conditioning unit and the second space conditioning unit are interconnected with an arrangement of channels suitable for passing the liquid desiccant; and a branch controller for channeling the liquid desiccant received processed by the first space conditioning unit to either the liquid desiccant conditioning unit or the second space conditioning unit, wherein the branch controller includes a processor for comparing operational conditions of the first space conditioning unit and the second space conditioning unit, for selecting between the first path and the second path based on the comparison and for commanding the fluid control system to control the flow of the liquid desiccant according to the selected path, wherein comparing the operational conditions includes comparing at least one of sensible loads and latent loads of the first and the second space conditioning units, wherein the sensible load of each space conditioning unit includes a temperature difference between a current and a requested temperature in a space controlled by each space conditioning unit, and wherein the latent load of each space conditioning unit includes a humidity difference between a current and a requested humidity in the space controlled by each space conditioning unit.

14. The system of claim 13, wherein the branch controller includes a heat exchanger for changing the temperature of the liquid desiccant received from the first space conditioning unit before redirecting the liquid desiccant to the second space conditioning unit.

15. The system of claim 13, further comprising:

a reservoir connected to the liquid desiccant conditioning unit for storing the concentrated liquid desiccant.

16. The system of claim 13, wherein the liquid desiccant conditioning comprises:

a first heat exchanger for heating the liquid desiccant in a diluted state using secondary fluid at a high temperature to change the concentration of the liquid desiccant and to reduce a temperature of the secondary fluid to a low temperature;

a second heat exchanger for cooling the liquid desiccant in a concentrated state using a first part of the secondary fluid at the low temperature; and wherein the branch controller comprises:

a fluid control system for controlling a flow of the liquid desiccant in the arrangement of channels;

a processor for comparing operational conditions of the first space conditioning unit and the second space conditioning unit to determine a direction of a flow of the liquid desiccant; and a heat exchanger for cooling the liquid desiccant received from the first space conditioning unit before redirecting the liquid desiccant to the second space conditioning unit using a second part of the secondary fluid at the low temperature received from the liquid desiccant conditioning unit.

17. A method for controlling temperature and humidity in multiple spaces using a liquid desiccant, comprising:

comparing an operational condition of a first space conditioning unit arranged for controlling a first environment using the liquid desiccant with an operational condition of a second space conditioning unit arranged for controlling a second environment using the liquid desiccant, wherein comparing the operational conditions includes comparing at least one of sensible loads and latent loads of the first and the second space conditioning units, wherein the sensible load of each space conditioning unit includes a temperature difference between a current and a requested temperature in a space controlled by each space conditioning unit, and wherein the latent load of each space conditioning unit includes a humidity difference between a current and a requested humidity in the space controlled by each space conditioning unit;

selecting, in response to the comparing, between a first path for directing the liquid desiccant received from the first space conditioning unit to a liquid desiccant conditioning unit and a second path for directing the liquid desiccant received from the first space conditioning unit to a second space conditioning unit; and directing a flow of the liquid desiccant according to the selected path.

18. The method of claim 17, further comprising:

changing a temperature of the liquid desiccant without changing a concentration of the liquid desiccant before directing the liquid desiccant according to the second path.

19. The method of claim 17, wherein the comparing includes comparing latent loads of the first and the second space conditioning units, further comprising:

directing, first, the liquid desiccant to the first space conditioning unit having a higher latent load than a latent load of the second space conditioning unit, and directs, second, the liquid desiccant to the second space conditioning unit.

* * * * *